United States Patent [19]

Kano et al.

[11] Patent Number: 4,711,217

[45] Date of Patent: Dec. 8, 1987

[54] FUEL SUPPLY CONTROL METHOD FOR INTERNAL COMBUSTION ENGINES AT LOW TEMPERATURE

[75] Inventors: Hidekazu Kano, Higashimatsuyama; Takashi Shinchi, Kawagoe; Shuichi Hosoi, Ichikawa, all of Japan

[73] Assignee: Honda Giken Kogyo Kabushiki Kaisha, Tokyo, Japan

[21] Appl. No.: 840,460

[22] Filed: Mar. 17, 1986

[30] Foreign Application Priority Data

Mar. 18, 1985 [JP] Japan ..... 60-052508

[51] Int. Cl.[4] ..... F02D 41/06; F02M 51/00

[52] U.S. Cl. ..... 123/491; 123/486

[58] Field of Search ..... 123/478, 480, 486, 491

[56] References Cited

U.S. PATENT DOCUMENTS 4,469,072 9/1984 Kobayashi et al. ..... 123/491
4,492,206 1/1985 Hasegawa et al. ..... 123/491
4,508,084 4/1985 Yamato et al. ..... 123/491 X
4,531,495 7/1985 Yamato et al. ..... 123/491 X

FOREIGN PATENT DOCUMENTS 0137633 8/1982 Japan .
2120417 11/1983 United Kingdom .

*Primary Examiner*—Willis R. Wolfe, Jr.
*Attorney, Agent, or Firm*—Lyon & Lyon

[57] ABSTRACT

A fuel supply control method for an internal combustion engine in a cold state. A basic value of fuel supply quantity is corrected to an increased value by the use of a correction variable set based upon engine temperature and engine load. Intake air temperature is detected, and the correction variable is corrected by the detected intake air temperature. Preferably, the correction variable is corrected to a larger value as the detected intake air temperature is lower.

5 Claims, 6 Drawing Figures

FUEL INJECTION VALVE
4
INTERNAL COMBUSTION ENGINE
1
THREE-WAY CATALYST
15
3
O2
14
Tw
13
Ne
12
TA
11
PBA
10
9
θTH
7
6
2
5
8
8a
8b
8c
8d
INPUT CIRCUIT
CPU
MEMORY MEANS
OUTPUT CIRCUIT
ECU
OTHER PARAMETER SENSORS
16
STARTER SWITCH
17

FUEL SUPPLY CONTROL METHOD FOR INTERNAL COMBUSTION ENGINES AT LOW TEMPERATURE

BACKGROUND OF THE INVENTION

This invention relates to a method of controlling the quantity of fuel being supplied to an internal combustion engine when the engine is in a cold state.

A fuel supply control method for internal combustion engines has been proposed, e.g. by Japanese Provisional Patent Publication (Kokai) No. 57-137633, which is adapted to control the air-fuel ratio of an air-fuel mixture being supplied to an internal combustion engine by electrically controlling the valve opening period of a fuel injection valve through which fuel is supplied to the engine, that is, by controlling the fuel injection quantity.

According to this proposed fuel supply control method, the valve opening period of the fuel injection valve is determined by adding values of various correction variables such as an intake air temperature-dependent correction variable and a warming-up fuel increasing correction variable to and/or multiplying thereby a basic value of valve opening period corresponding to the enging rotational speed and a parameter representing the engine load, e.g. intake pipe absolute pressure.

Since the above basic value is set based on air density at a predetermined reference value of intake air temperature (e.g. 30° C.), the intake air temperature-dependent correction variable is used to correct the basic value in order to compensate for a change in the air density caused by deviation of the intake air temperature from the predetermined reference value. On the other hand, since there can be a difference between the quantity of fuel injected and that actually drawn and burnt in the cylinder, depending upon the atomization degree of injected fuel and the quantity of the injected fuel adhering to the wall of the intake pipe, the warming-up fuel increasing correction variable is used to correct the basic value to compensate for the difference.

The warming-up fuel increasing correction variable is determined based not only on engine temperature, e.g. engine cooling water (coolant) temperature, but also on the intake pipe absolute pressure, because, even if the engine temperature remains unchanged, a change in the intake pipe absolute pressure, i.e., a change in the flow rate of air in the intake pipe can result in a corresponding change in the quantity of fuel adhering to the intake pipe wall as well as a change in the fuel atomization degree.

However, the atomization degree of injected fuel also varies as a function of the intake air temperature, too, and hence a further correction with regard thereto is required. In particular, when the intake air temperature is low, it is difficult for the conventional fuel supply control method to secure the supply of such a proper quantity of an air-fuel mixture to the engine as to obtain stable combustion and stable engine rotation, thus suffering from degradation in the driveability of the engine, etc.

SUMMARY OF THE INVENTION

It is an object of the invention to provide a fuel supply control method for internal combustion engines, which is adapted to use the intake air temperature as one of the determinants of the engine temperature-dependent fuel increasing correction variable to stabilize the engine rotation, thereby improving the driveability the engine, especially when the intake air temperature is low.

According to the present invention, there is provided a method of controlling the quantity of fuel being supplied to an internal combustion engine in a cold state, wherein a basic value of the quantity of fuel being supplied to the engine is corrected to an increased value by the use of a fuel increasing correction variable which is set based upon a temperature of the engine and a load on the engine. The method is characterized by comprising the following steps: (1) detecting a temperature of intake air being supplied to the engine, and (2) correcting the fuel increasing correction variable by the intake air temperature detected.

Preferably, the fuel increasing correction variable is corrected to a larger value as the intake air temperature detected is lower.

Also, the temperature of the engine is preferably the temperature of engine coolant.

Further, the load on the engine is preferably the absolute pressure in an intake pipe of the engine.

Still more preferably, the fuel increasing correction variable is a coefficient by which the basic value is multiplied.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
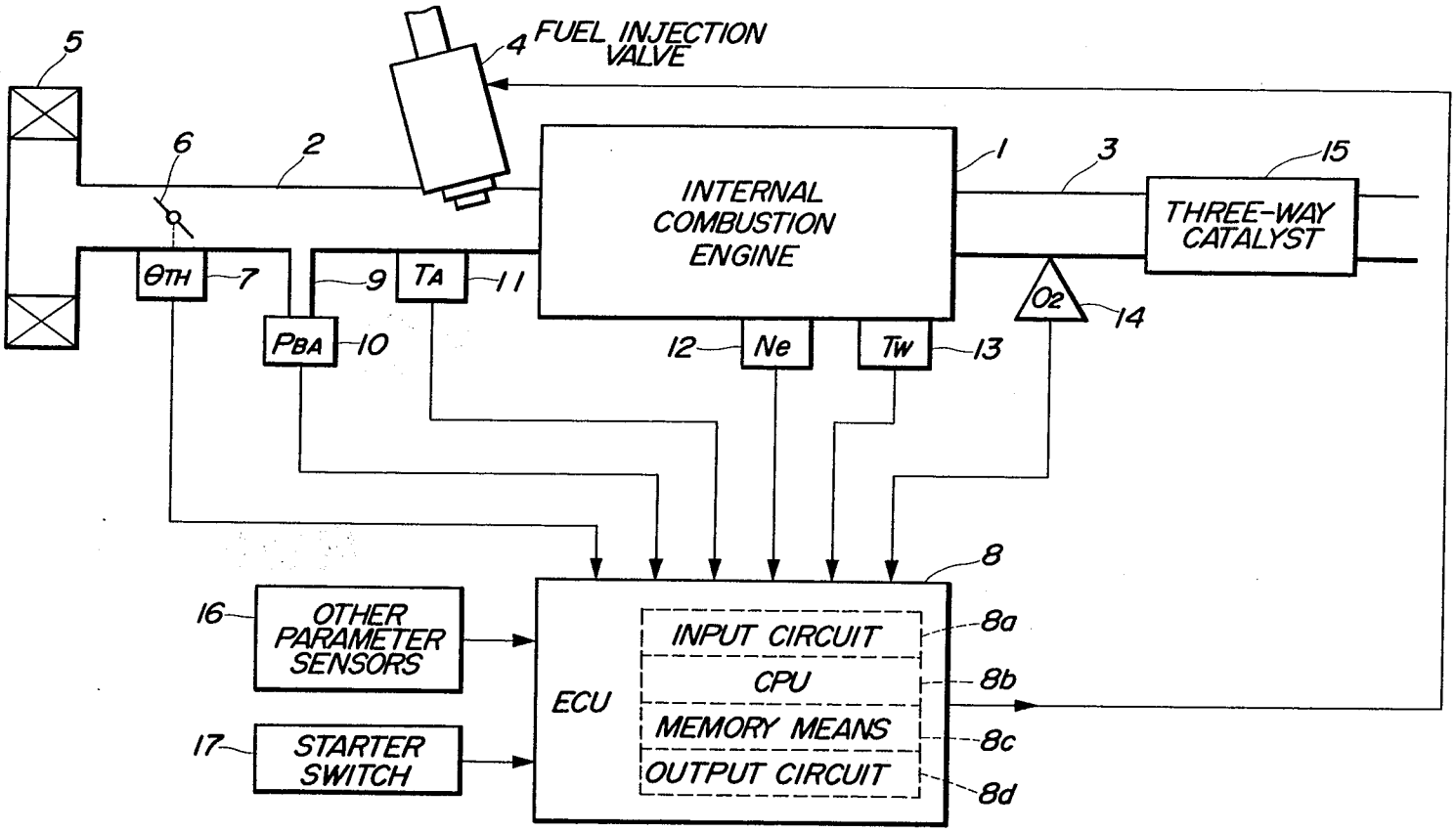
FIG. 1 is a block diagram illustrating the whole arrangement of an internal combustion engine equipped with a fuel supply control system to which the method of the present invention is applied.

Referring first to FIG. 1, there is illustrated the whole arrangement of an internal combustion engine equipped with a fuel supply control system to which the method of the present invention is applied. Reference numeral 1 designates the engine which may be a four cylinder type. Connected to each cylinder are an intake pipe 2 and an exhaust pipe 3.

Fuel injection valves 4 are inserted in the intake pipe 2 in the vicinity of the engine 1, and an air cleaner 5 is provided at an inlet end of the intake pipe 2 opening into the atmosphere. Arranged across the intake pipe 2 at a location upstream of the fuel injection valves 4 is a throttle valve 6, to which a throttle valve opening ($\theta$TH) sensor 7 is connected for detecting the valve opening. The throttle valve opening sensor 7 converts the detected throttle valve opening into an electrical signal to supply same to an electronic control unit (hereinafter called "ECU") 8 to which it is electrically connected.

An absolute pressure (PBA) sensor 10 communicates through a conduit 9 with the interior of the intake pipe 2 at a location between the throttle valve 6 and the fuel injection valves 4, to detect the absolute pressure in the intake pipe 2 and convert same into an electrical signal to supply same to the ECU 8, to which it is connected.

Further, an intake air temperature (TA) sensor 11 is inserted in the intake pipe 2 at a location between the conduit 9 and the fuel injection valves 4, to detect the temperature of intake air passing in the intake pipe 2 and convert the detected intake air temperature into an electrical signal to supply to the ECU 8, to which it is also connected.

The fuel injection valves 4 are each connected to a fuel pump (not shown), and electrically connected to the ECU 8 to have its valve opening period controlled by a driving signal supplied from the ECU 8.

Mounted on the cylinder block of the engine 1 are an engine rotational speed (Ne) sensor 12 and an engine temperature (TW) sensor 13. The latter 13 is adapted to detect the temperature of engine cooling water (coolant) as an engine temperature and convert same into an electrical signal to supply to the ECU 8, to which it is electrically connected.

The engine rotational speed sensor 12 is adapted to generate one pulse of a crank-angle-position signal (hereinafter called "TDC signal") at a particular crank angle position of each cylinder of a predetermined crank angle before a top-dead-center of the cylinder corresponding to the start of the suction stroke each time the engine crankshaft rotates through 180 degrees. The TDC signal thus generated is supplied to the ECU 8 to which the sensor 12 is connected.

An $O_2$ sensor 14 is inserted in the exhaust pipe 3 for detecting oxygen concentration in the exhaust gases and converting same into an electrical signal to supply to the ECU 8, to which it is electrically connected. A three-way catalyst 15 is arranged across the exhaust pipe 3 at a location downstream of the $O_2$ sensor 14 for purifying ingredients HC, CO and NOx contained in the exhaust gases.

Further connected to the ECU 5 are other parameter sensors 16 such as an atmospheric pressure sensor for detecting atmospheric pressure, and a starting switch 17 for actuating the engine 1, the other parameter sensors 16 being also electrically connected to the ECU 8 to supply same with respective electrical signals representing the detected values.

The ECU 8 comprises an input circuit **8*a* having such functions as shaping the waveforms of signals inputted from various sensors, shifting the voltage levels of other input signals to a predetermined level, and converting the values of analog signals into degital values, a central processing unit (hereinafter called "CPU") 8*b*, storage means 8*c* for storing various calculation programs to be executed in the CPU 8*b*, the results of calculations, etc., and an output cirucuit 8*d* having such functions as supplying the fuel injection valves 6** with driving signals to open them in response to the results of calculations.

The respective engine parameter signals from the aforementioned sensors and the on-off signal from the starting switch 17 are supplied to the CPU **8*b* through the input circuit 8*a* in the ECU 8. The CPU 8*b* determines operating conditions of the engine by processing the engine parameter signal values and the on-off signal value through a predetermined control program, and calculates the quantity of fuel to be supplied to the engine 1, i.e., the fuel injection period TOUT of the fuel injection valves 4, and then supplies the fuel injection valves 4 via the output circuit 8*d*** with the driving signals to drive same in response to the result of the calculation.

The fuel injection period TOUT for the fuel injection valves 4 is calculated by the following equation (1):

$$TOUT = Ti \times KTA \times KTW \times K1 + K2 \quad (1)$$

where Ti is a basic value of the fuel injection period, for which a plurality of predetermined values are stored in the storage means **8*c* in the ECU 8, each of the predetermined values corresponding to a respective one of combinations of values of intake pipe absolute pressure PBA and engine rotational speed Ne and being set at such a value as to supply an optimal fuel quantity on condition that the intake air temperature TA and the engine cooling water temperature TW assume respective predetermined reference values. Thus, the basic value Ti is set to a value read from the storage means 8*c*** in response to the values PBA and Ne detected.

Figure 2:
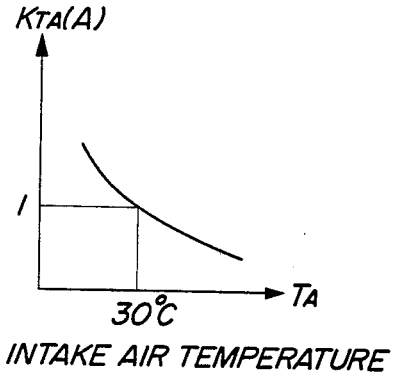
FIG. 2 is a graph showing the relationship between the intake air temperature TA and an intake air temperature-dependent correction coefficient KTA.

KTA is an intake air temperature correction coefficient to compensate for a deviation of the detected intake air temperature from the predetermined reference value (e.g. 30° C.), the value of the coefficient KTA is read from a table as shown in FIG. 2 in response to the intake air temperature TA detected. KTW is a warming-up fuel increasing correction coefficient, or a coolant temperature-dependent fuel increasing correction coefficient, which will be described later in detail.

K1 and K2 are correction coefficients and correction variables, respectively, which are determined as functions of the values of various engine parameters except for the intake air temperature TA and the engine temperature TW, and are set to such values as to achieve optimal operating characteristics of the engine such as fuel consumption and emission characteristics.

Figure 4:
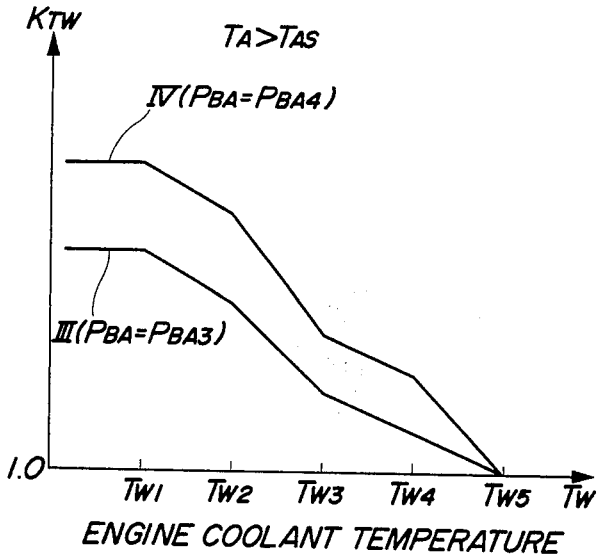
FIG. 4 is a graph showing a table of the relationship between the engine cooling water temperature TW and the engine temperature-dependent fuel increasing correction coefficient KTW at predetermined intake pipe absolute pressure values $PBA_1$ and $PBA_2$, which is applied when the intake air temperature TA is higher than the predetermined value TAS.
Figure 3:
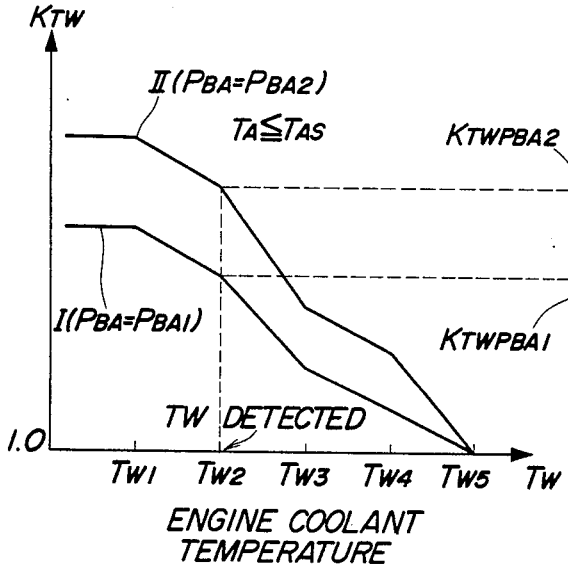
FIG. 3 is a graph showing a table of the relationships between the engine cooling water temperature TW and the engine coolant temperature-dependent fuel increasing correction coefficient KTW at predetermined intake pipe absolute pressure values $PBA_1$ and $PBA_2$, which is applied when the intake air temperature TA is equal to or lower than a predetermined value TAS.

The engine coolant temperature-dependent fuel increasing correction coefficient KTW is read from tables shown in FIGS. 3 and 4, for instance.

FIGS. 3 and 4 show examples of the relationship between the engine water temperature TW and the engine coolant temperature-dependent fuel increasing correction coefficient KTW. FIG. 3 is applied when the intake air temperature TA is equal to or lower than a predetermined value TAS (e.g. 20° C.), and FIG. 4 when the intake air temperature TA exceeds the predetermined value TAS, respectively. It is so arranged that the value KTW read from FIG. 3 is greater than that read from FIG. 4 at the same value of engine water temperature TW and the same value of intake pipe absolute pressure PBA.

Now the manner of obtaining the engine coolant temperature-dependent fuel increasing correction coefficient KTW from the tables of FIGS. 3 and 4 will be described with reference to FIG. 5 and FIG. 6.

Figure 6:
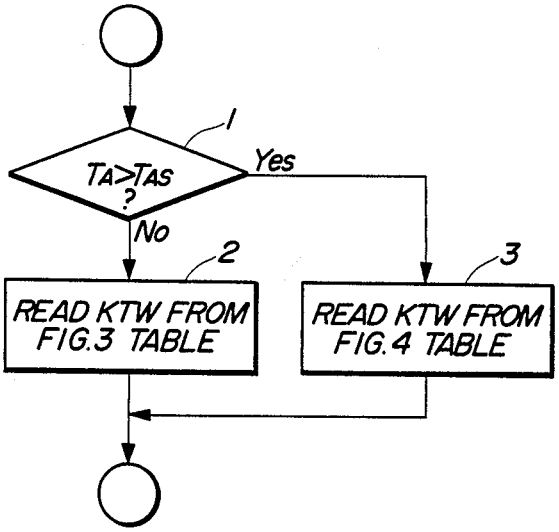
FIG. 6 is a flowchart showing part of a procedure for determining a desired value of engine temperature-dependent fuel increasing correction coefficient KTW.

First, it is determined at step 1 in FIG. 6 whether or not the actual intake air temperature TA is higher than the predetermined value TAS. If the answer is negative (No), the program proceeds to step 2, where a value of the engine coolant temperature-dependent fuel increasing correction coefficient KTW is read from the table of FIG. 3 based on the detected intake pipe absolute pressure PBA and the detected engine water temperature TW. If the answer is affirmative (Yes), the program proceeds to step 3, where a value of the correction coefficient KTW is read from the table of FIG. 4 based on the detected intake pipe absolute pressure PBA and the detected engine water temperature TW.

By way of example, let it be assumed that the detected intake air temperature TA is equal to or lower than the predetermined value TAS (20° C.), reading from the table of FIG. 3 is effected as follows:

In, FIG. 3, the curve I indicates values KTWPBA1 to be selected at a first predetermined value PBA1 of intake pipe absolute pressure (e.g. 300 mmHg), and II values KTWPBA2 to be selected at a second predetermined value PBA2 of intake pipe absolute pressure (e.g. 650 mmHg), respectively. Thus, values $KTWPBA_1$ and $KTWPBA_2$ are selectively read in response to the detected water temperature TW, depending upon the detected intake pipe absolute pressure. As is learned from the table, when the water temperature TW exceeds a predetermined value $TW_5$ (e.g. 60° C.), the values $KTWPBA_1$ and $KTWPBA_2$ are read as 1.0. Besides $TW_5$ there are provided four predetermined coolant temperature values $TW_1$ through $TW_4$ as calibration variables (increasing in the order of the index number), and five predetermined values KTWPBAij corresponding to respective predetermined values $TW_j$ (j=1, 2, 3, 4, or 5). If the detected coolant temperature assumes a value falling between adjacent ones of the predetermined values $TW_1$ through $TW_5$, then the values $KTWPBA_1$ and $KTWPBA_2$ are calculated by means of linear interpolation.

Figure 5:
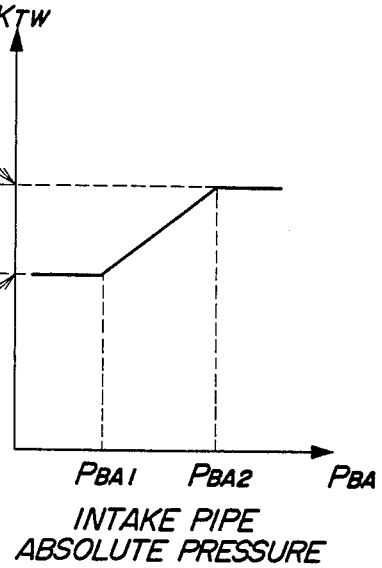
FIG. 5 is a graph showing the relationship between the engine temperature-dependent fuel increasing correction coefficient KTW and values $KTWPBA_1$ and $KTWPBA_2$ obtained from FIG. 3 and intake pipe absolute pressure PBA detected.

Based on the values $KTWPBA_1$ and $KTWPBA_2$ thus obtained, the coolant temperature-dependent fuel increasing correction coefficient KTW is finally obtained in response to the actual intake pipe absolute pressure PBA as shown by FIG. 5. To be specific, if the intake pipe absolute pressure PBA is equal to or greater than the second predetermined intake pipe absolute pressure value $PBA_2$ (e.g. 650 mmHg), the value KTW is read as $KTWPBA_2$, and if the intake pipe absolute pressure PBA is equal to or less than the first predetermined intake pipe absolute pressure value $PBA_1$ (e.g. 300 mmHg), the value KTW is read as $KTWPBA_1$. If the intake pipe absolute pressure PBA falls intermediate between $PBA_1$ and $PBA_2$, the value KTW is set to a value intermediate between $KTWPBA_1$ and $KTWPBA_2$ by means of linear interpolation.

A similar manner of determining the KTW value to the above is applicable in the case where the intake air temperature TA detected is higher than the predetermined temperature TAS (e.g. 20° C.), i.e., the case where the table of FIG. 4 is selected. Therefore, the explanation is omitted.

The coolant temperature-dependent fuel increasing correction coefficient KTW thus obtained is substituted into the equation (1), whereby it is assured that a sufficient quantity of fuel is always supplied to the combustion chamber of each cylinder of the engine even when the intake air temperature is low and accordingly the atomization degree of the injected fuel is low, to thereby stabilize the engine rotation and improve the driveability.

Although in this embodiment two TW-KTW tables are provided (FIGS. 3 and 4) for determining the KTW value as stated above, which are selected depending upon whether the intake air temperature TA is above or below the predetermined value TAS, a three-dimensional table, which employs intake air temperature TA, engine cooling water temperature TW, and intake pipe absolute pressure PBA, as parameters for determining the KTW value, from which table the KTW value can be directly read in response to a combination of the detected values of these parameters.

Also, in obtaining the desired cooling water temperature fuel incremental correction coefficient KTW interpolation may be conducted with regard to intake pipe absolute pressure PBA before conducting interpolation with regard to engine cooling water temperature TW.

Further, the parameter representing the engine load may be throttle valve opening or intake air quantity in lieu of intake pipe absolute pressure.

As set forth above, according to the method of the invention, warming-up or engine temperature-dependent fuel increasing correction coefficient (engine coolant temperature, dependent fuel increasing correction coefficient), which is one of the factors to determine a desired quantity of fuel to be supplied to an internal combustion engine, is set to an appropriate value as a function of intake air temperature as well as engine temperature (engine coolant temperature) and intake pipe absolute pressure, to thereby enable compensating for a change in the atomization degree of the injected fuel caused by variation in the intake air temperature and hence prevent the atomization degree change from affecting the engine operating condition, whereby the engine rotation is stabilized and the driveability is improved.

What is claimed is:

1. A method of controlling the quantity of fuel being supplied to an internal combustion engine in a cold state, wherein a basic value of the quantity of fuel being supplied to said engine is corrected by the use of a first correction value which is set based upon a difference between a predetermined value and an actual value of temperature of intake air being supplied to said engine and a second correction value which is set based upon a temperature of said engine and a load on said engine, said second correction value being applied when said engine is in said cold state, to correct said basic value of the quantity of fuel to an increased value, said method comprising the steps of: (1) detecting a temperature of intake air being supplied to said engine, and (2) correcting said second correction value by said intake air temperature detected in a manner such that said second correction value is corrected to a larger value as said intake air temperature detected is lower.

2. A method of controlling the quantity of fuel being suppied to an internal combustion engine in a cold state, wherein a basic value of the quantity of fuel being supplied to said engine is corrected by the use of a fuel increasing correction variable which is set based upon a temperature of said engine and a load on said engine, said fuel increasing correction variable being applied exclusively when said engine is in said cold state, to correct said basic value of the quantity of fuel to an increased value, said method comprising the steps of: (1) detecting a temperature of intake air being supplied to said engine, and (2) correcting said fuel increasing correction variable by said intake air temperature detected in a manner such that said fuel increasing correction variable is corrected to a larger value as said intake air temperature detected is lower.

3. A method as claimed in claim 2, wherein said temperature of said engine is the temperature of engine coolant.

4. A method as claimed in claim 2, wherein said load on said engine is the absolute pressure in an intake pipe of said engine.

5. A method as claimed in claim 2, wherein said fuel increasing correction variable is a coefficient by which said basic value is multiplied.

* * * * *